US009625231B1

(12) United States Patent
Hass

(10) Patent No.: US 9,625,231 B1
(45) Date of Patent: Apr. 18, 2017

(54) RACK AND PINION LEVER-ACTION RIFLE

(71) Applicant: David N. Hass, Wynantskill, NY (US)

(72) Inventor: David N. Hass, Wynantskill, NY (US)

( * ) Notice: Subject to any disclaimer, the term of this patent is extended or adjusted under 35 U.S.C. 154(b) by 0 days.

(21) Appl. No.: 15/005,101

(22) Filed: Jan. 25, 2016

(51) Int. Cl.
*F41C 7/06* (2006.01)
*F41A 3/42* (2006.01)
*F41A 9/70* (2006.01)

(52) U.S. Cl.
CPC ..... *F41C 7/06* (2013.01); *F41A 3/42* (2013.01); *F41A 9/70* (2013.01)

(58) Field of Classification Search
CPC ..... F41A 3/12; F41A 3/14; F41A 3/36; F41A 3/54; F41A 3/64; F41A 3/72; F41A 9/00; F41A 9/01; F41A 9/20; F41A 9/22; F41A 9/23; F41A 9/38; F41A 9/39; F41A 9/40; F41A 9/41; F41A 9/61; F41A 9/64; F41A 9/65; F41A 9/70; F41A 19/00; F41A 19/06; F41A 19/10; F41A 19/12; F41A 19/14; F41A 19/42; F41A 19/43; F41A 19/47; F41A 19/50; F41A 19/52; F41C 7/00; F41C 7/06
USPC ..... 42/6, 16, 17, 18, 49.01, 50, 69.01, 69.02
See application file for complete search history.

(56) References Cited

U.S. PATENT DOCUMENTS

| | | | | |
|---|---|---|---|---|
| 245,700 | A | 8/1881 | Bullard | |
| 1,322,438 | A * | 11/1919 | Henderson | F41A 17/38 42/18 |
| 3,377,731 | A * | 4/1968 | Lawrence | F41C 7/06 42/20 |
| 3,471,961 | A * | 10/1969 | Lewis | F41A 3/18 42/20 |
| 4,095,363 | A * | 6/1978 | Riedl | F41A 3/10 42/23 |
| 5,148,619 | A | 9/1992 | Badali | |
| 2007/0214696 | A1* | 9/2007 | Barnett | F41C 7/06 42/16 |
| 2010/0175547 | A1* | 7/2010 | Hoffman | F41A 7/08 89/9 |

* cited by examiner

*Primary Examiner* — Bret Hayes
(74) *Attorney, Agent, or Firm* — Harris Beach PLLC; Neal L. Slifkin

(57) ABSTRACT

A firearm, more specifically a rack and pinion lever-action rifle with a receiver, a barrel having a chamber and joined to said receiver, a cartridge magazine with a cartridge, a sliding bolt with a rack surface and an extractor, and a pinion in direct contact with the bolt. A claw on the pinion delivers a cartridge from the cartridge magazine to the extractor. A lever member is also connected to the receiver with the pivot pin and alternates between a coupled configuration and a partially uncoupled configuration with the pinion via a locking pin. A decoupling pin releases the pinion from a coupled configuration with the lever member. A bolt pin couples with a locking groove in a sliding bolt cap on the locked sliding bolt. A hammer, hammer spring, sear, trigger, and firing pin interact to discharge the firearm. An ejector ejects spent cartridges out of the receiver.

8 Claims, 13 Drawing Sheets

RACK AND PINION LEVER-ACTION RIFLE

TECHNICAL FIELD

The present invention relates to the field of firearms; more particularly, to a rack and pinion lever-action rifle.

BACKGROUND OF THE INVENTION

In lever-action firearms a lever located around the trigger is used to load cartridges into the chamber of the barrel when the lever is worked. Most lever-action firearms are rifles.

The lever moves a bolt rearward in the receiver when rotated downward and forward. As the bolt moves rearward, an extractor pulls a spent cartridge from the chamber and propels the empty cartridge either from the top of the receiver or through a port on the side.

While the bolt moves rearward, a new cartridge is pushed from a magazine by a spring-loaded follower and presented to a carrier assembly that then lifts the new cartridge up in line with the bolt to be chambered when the lever is pulled rearward and upward. The rearward motion of the bolt cocks a hammer and engages a sear in a trigger. This prepares the firearm to fire. Once fired, the cycle can be repeated as the lever is operated by a user until the magazine is emptied of all cartridges.

Magazines on lever-action rifles are typically tubular in shape and are located under the barrel. Magazines are sometimes fed through the buttstock. They can also be box or integral box magazines mounted directly under the action.

U.S. Pat. No. 245,700, issued Aug. 16, 1881 discloses a lever-action rifle comprising a swinging lever operating a pivoted arm connected with and moving a carrier, said swinging lever being also connected with a link which carries a pinion traveling in a stationary rack, which pinion moves the bolt to and fro to carry the cartridge from the carrier into the barrel. The swinging lever is also connected with an arm pivoted to a lock used to secure a vertically-swinging breech-block up firmly against the bolt, the latter being adapted to move the breech-block in both directions. A projecting or pivoted piece on the handle of the swinging lever, which strikes against part of the trigger, adapts the arm to be discharged rapidly by the simple movement of the swinging lever to and fro.

U.S. Pat. No. 5,148,619, issued Sep. 22, 1992, discloses a rack and pinion system for a lever-action firearm that provides the rack element as a floating gear and includes a cam lever extension of the lever member. The cam lever extension applies rearward force directly to a bolt and compresses a spring between the lever member and the rack element. After the bolt breaks free from locking lugs, force is applied to the rack element by the lever member through the spring to complete the rearward movement of the bolt.

Existing lever-action designs such as the Marlin Model 336 use large clearances between the tang on the end of a lever and a slot in a bolt to lock the bolt. The Marlin Model 336 and other traditional lever-action rifles cock a hammer on opening the lever.

There is a need for a lever-action rifle with a smoother operation than existing lever-action rifles. There is also a need for a lever-action rifle with simpler safety features than in existing lever-action rifles.

SUMMARY

In accordance with one embodiment of the present invention, a firearm comprises a receiver, a barrel having a chamber at one end and joined to said receiver, a cartridge magazine to contain a cartridge, a sliding bolt with a rack surface and an attached extractor, and a pinion in direct contact with the bolt. A claw on the pinion is configured to deliver a cartridge from the cartridge magazine to the extractor on the face of the bolt when the pinion pivots. A lever member is also connected the receiver with the pivot pin and may alternate between a coupled configuration and a partially uncoupled configuration with the pinion. The coupling of the pinion and the lever member is achieved via a spring-loaded locking pin on the pinion. A decoupling pin releases the pinion from a coupled configuration with the lever member. Also, a bolt pin couples with a locking groove in a sliding bolt cap on the sliding bolt when in a locked position.

A hammer, hammer spring, sear, trigger, and firing pin interact to discharge the firearm. An ejector mounted in the side of the receiver pushes a spent cartridge so that it is ejected out a slot in the side of the receiver.

BRIEF DESCRIPTION OF THE DRAWINGS

The present invention will now be described, by way of example, with reference to the accompanying drawings, in which.

Figure 7A:
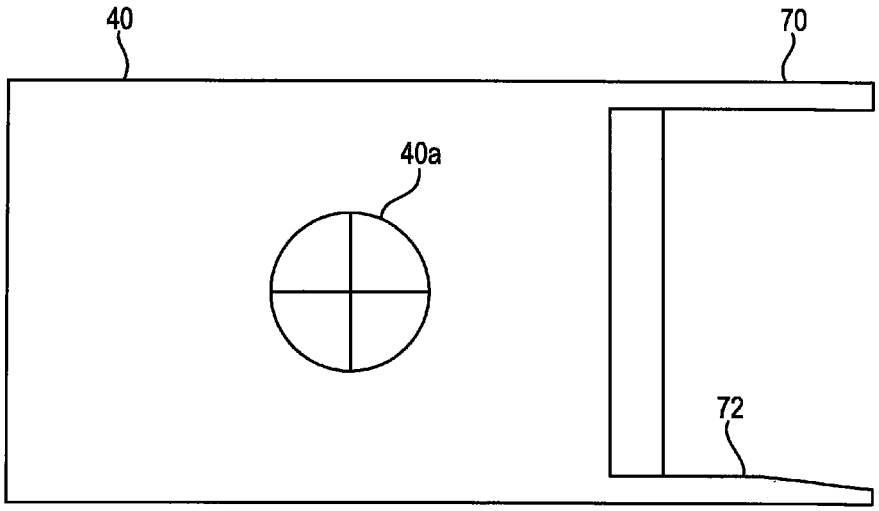
FIG. 7A is a bottom view of the claw.
Figure 7B:
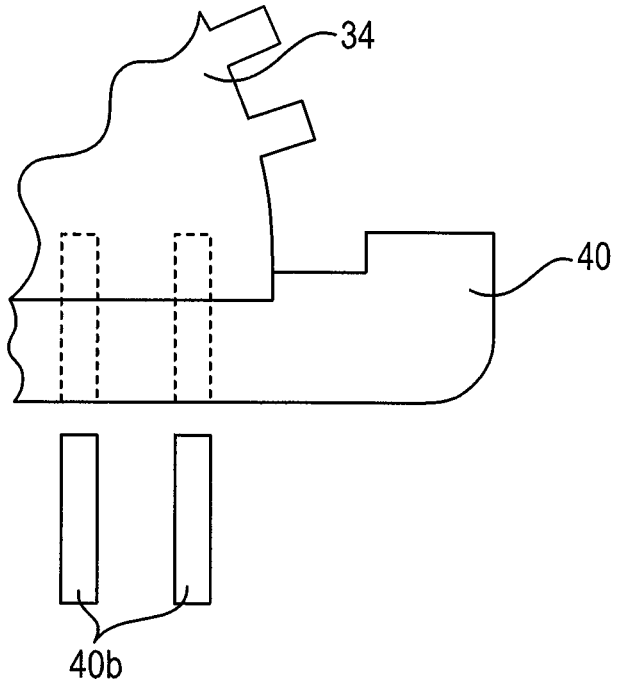
FIG. 7B is a side view of the claw and a portion of the pinion, with the claw pinned onto the pinion with a set of claw pins in an alternate embodiment.
Figure 7C:
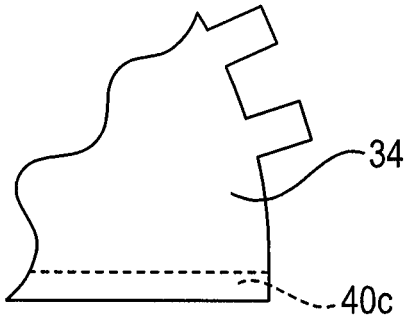
Figure 7D:
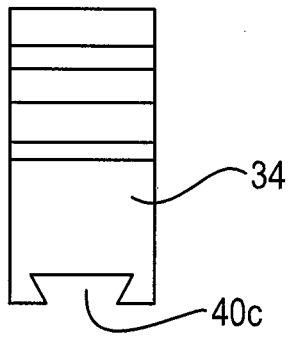
Figure 7E:
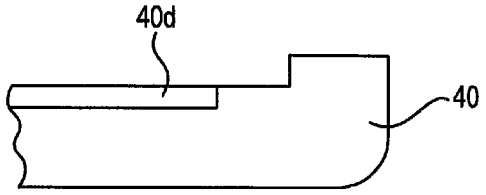
Figure 7F:
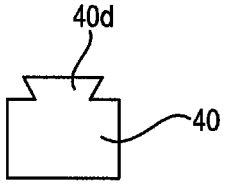
Figure 7G:
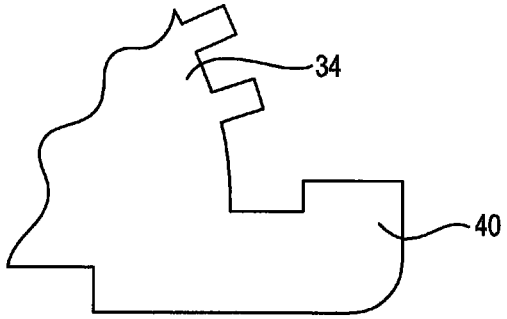
Figure 8B:
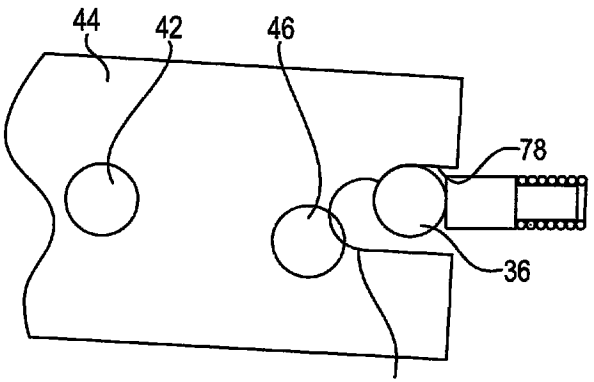
Figure 8A:
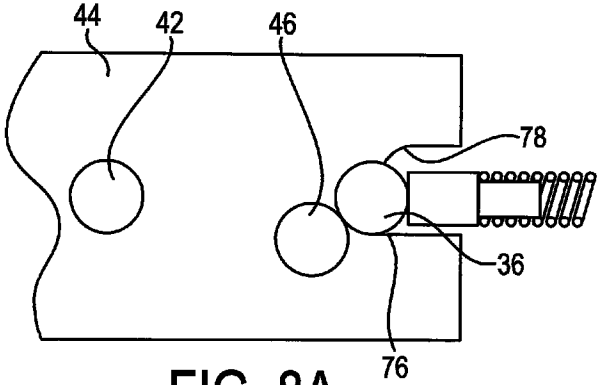
Figure 8C:
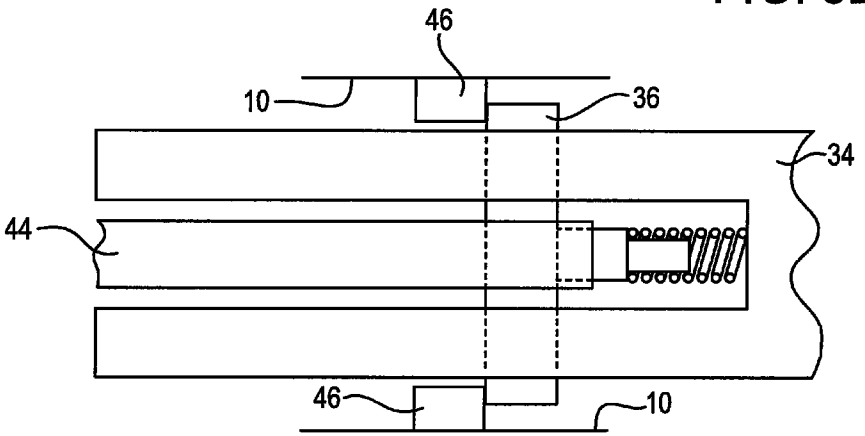
Figure 8D:
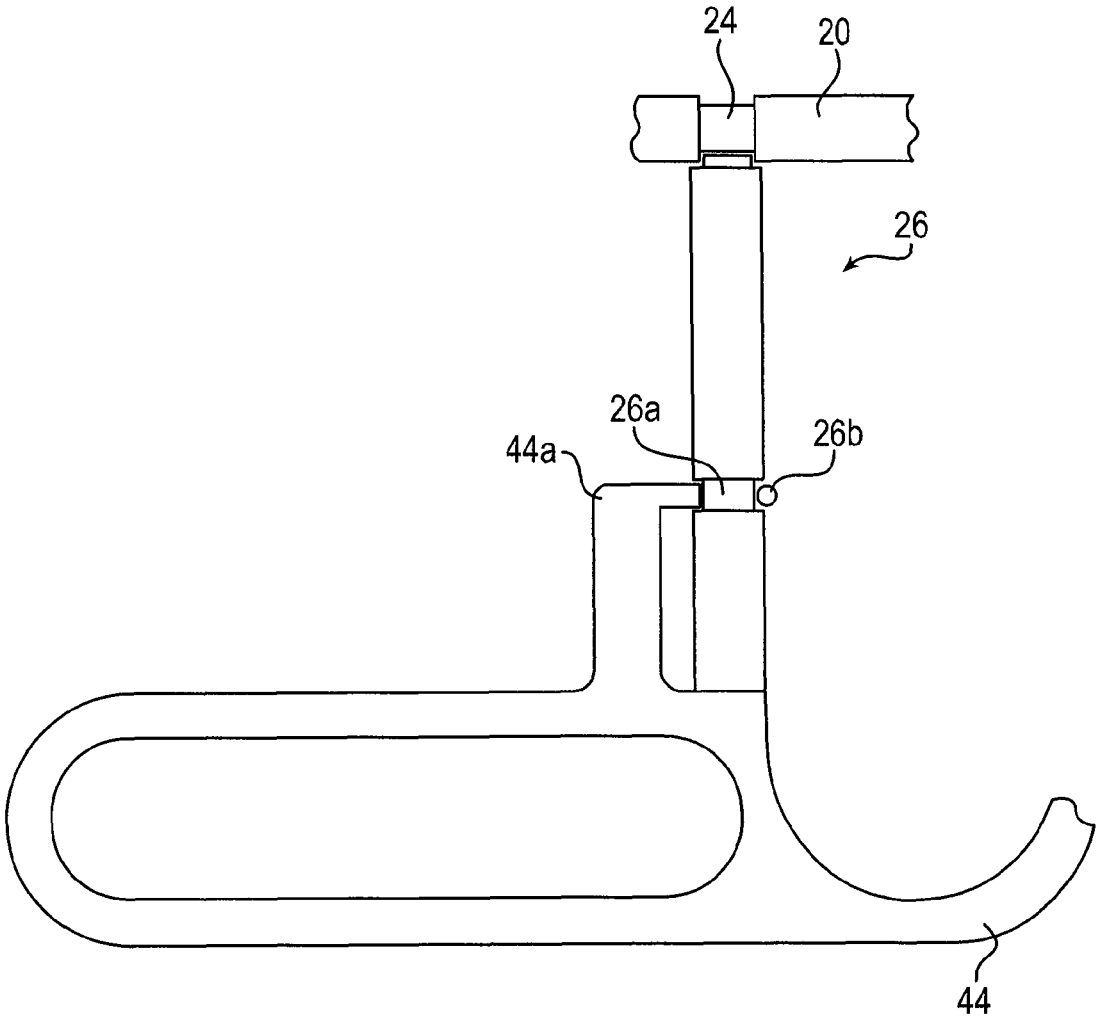
Figure 8E:
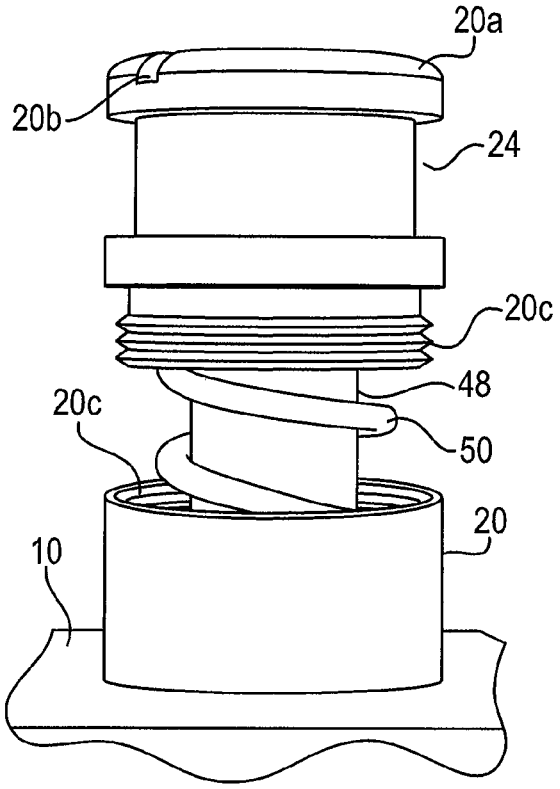
Figure 8F:
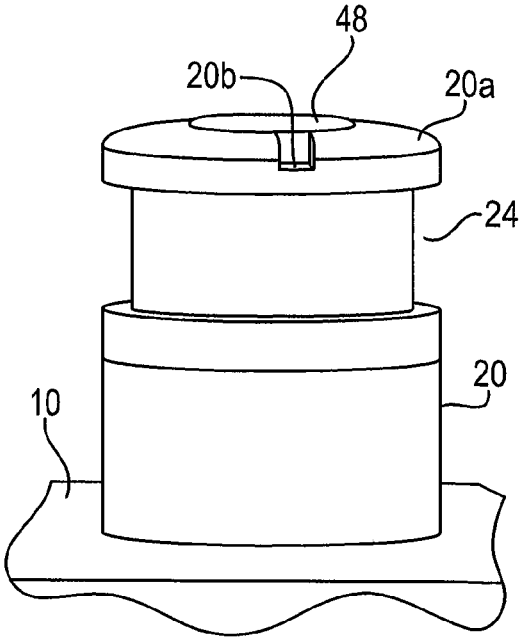
Figure 8G:
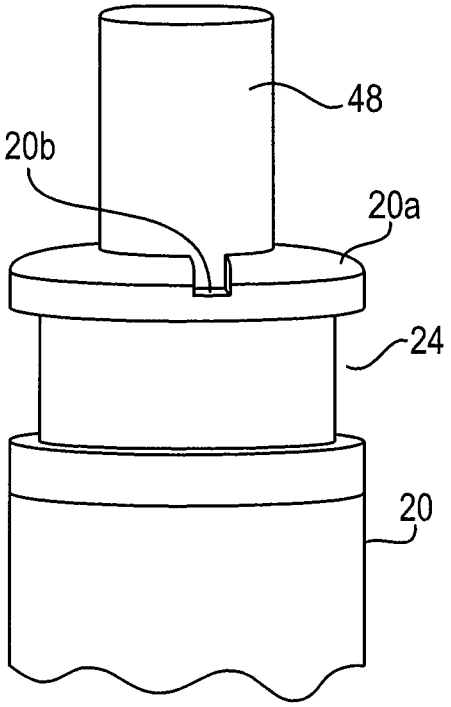
Figure 8H:
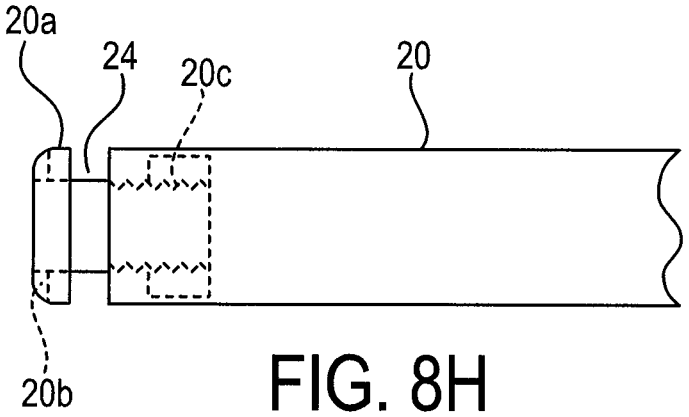
Figure 8I:
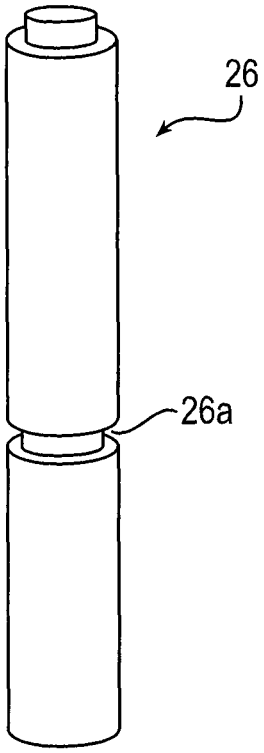
Figure 8J:
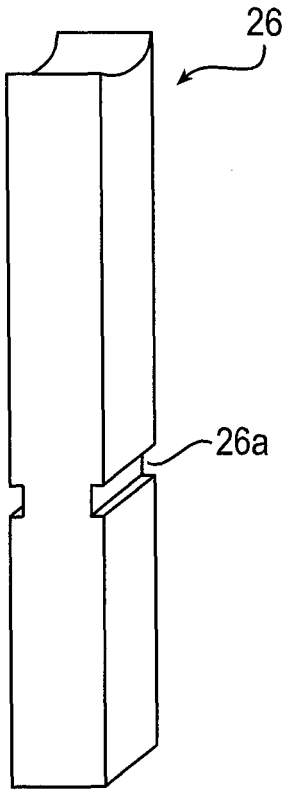
Figure 9A:
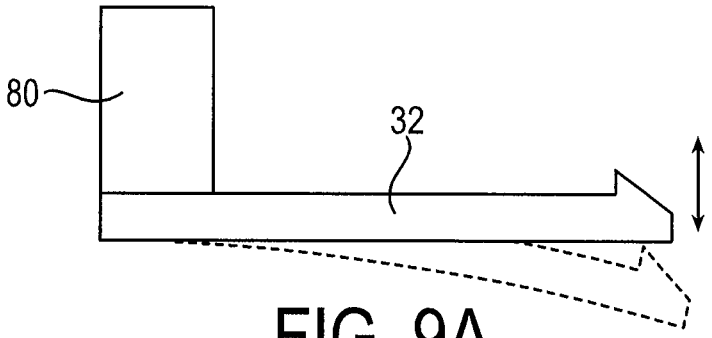
Figure 9B:
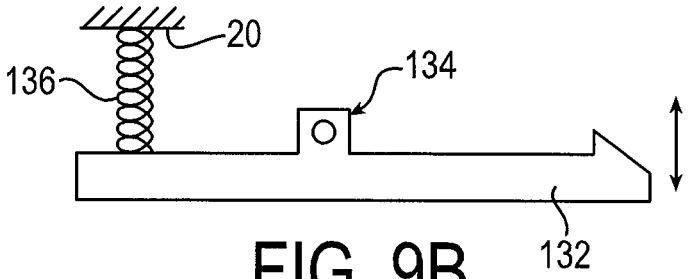
Figure 9C:
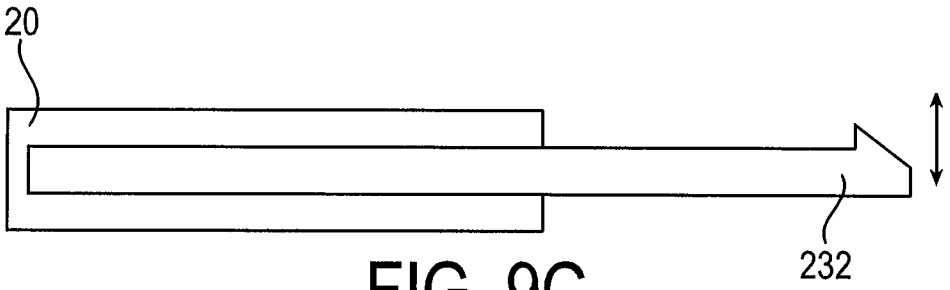
Figure 9D:
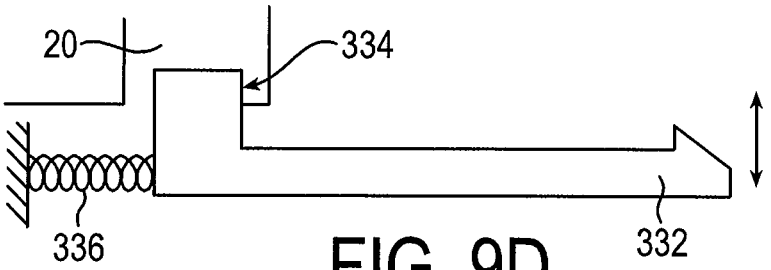

7C is a side view of a portion of the pinion with a dovetail socket in an alternate embodiment;

FIG. 7D is a front view of a portion of the pinion with a dovetail socket in an alternate embodiment;

FIG. 7E is side view of the claw with a dovetail in an alternate embodiment;

FIG. 7F is a cross-sectional view of the dovetail in the claw in an alternate embodiment;

FIG. 7G is a side view of a portion of the pinion and the claw, in which the claw is an integral part of the pinion in an alternate embodiment;

FIG. 8A is a side view of, among other things, a portion of the lever member, the spring-loaded locking pin, the pivot pin, and the decoupling pin, showing the position of each element in relation to the other when the lever member and the pinion are in the coupled configuration;

FIG. 8B is a side view of, among other things, a portion of the lever member, the spring-loaded locking pin, the pivot pin, and the decoupling pin, showing the position of each element in relation to the other when the lever member and the pinion are in the partially uncoupled configuration;

FIG. 8C is a top view of a portion of, among other things, the lever member, the spring-loaded locking pin, a portion of the pinion, the pivot pin, and the decoupling pin, and a portion of the receiver;

FIG. 8D is a side view of, among other things, a portion of the lever member, the pull-hook, the bolt pin, a portion of the sliding bolt, and a bolt pin retainer;

FIG. 8E is a perspective view of a sliding bolt cap, showing a locking groove, a screwdriver slot and threads in the sliding bolt cap, as well as portions of the sliding bolt, the hammer, the hammer spring, and the receiver;

FIG. 8F is a perspective view of a sliding bolt cap, showing a locking groove and a screwdriver slot, as well as a portion of the receiver;

FIG. 8G is a perspective view of a portion of a hammer protruding from the sliding bolt cap;

FIG. 8H is a side view of a threaded sliding bolt cap having a screwdriver slot and disposed on the end of a complementarily threaded sliding bolt;

FIG. 8I is a perspective view of a bolt pin with a generally cylindrical shape;

FIG. 8J is a perspective view of a bolt pin with a generally rectangular shape;

FIG. 9A is a top view of a leaf spring-type extractor in both deflected and non-deflected configurations with a clip for attachment of the extractor to the bolt;

FIG. 9B is a top view of a pivot-type extractor and a portion of the bolt with the extractor with a pivot point and a coil spring;

FIG. 9C is a top view of a rod cantilever-type extractor and a portion of the bolt with the extractor; and FIG. 9D is a top view of a pivot-type extractor and a portion of the bolt with the extractor with a hinge point and a hinge coil spring.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the disclosure. Accordingly, the specification and drawings are to be regarded as illustrative rather than restrictive. It is to be further noted that the drawing is not to scale.

Figure 1:
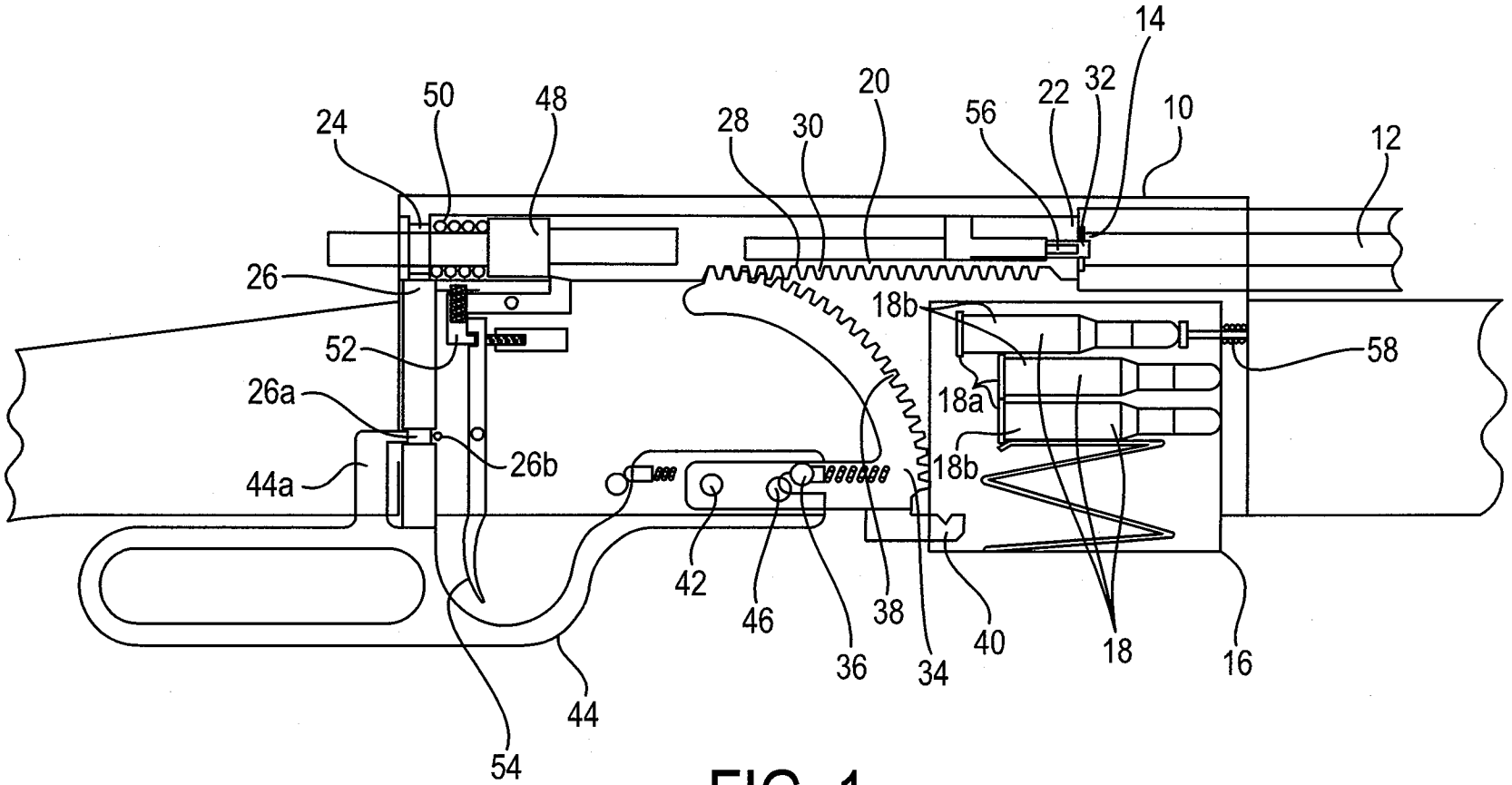
FIG. 1 is a cross section of a portion of a rack and pinion lever-action rifle with the bolt in the in-battery position taken along the middle.
Figure 2:
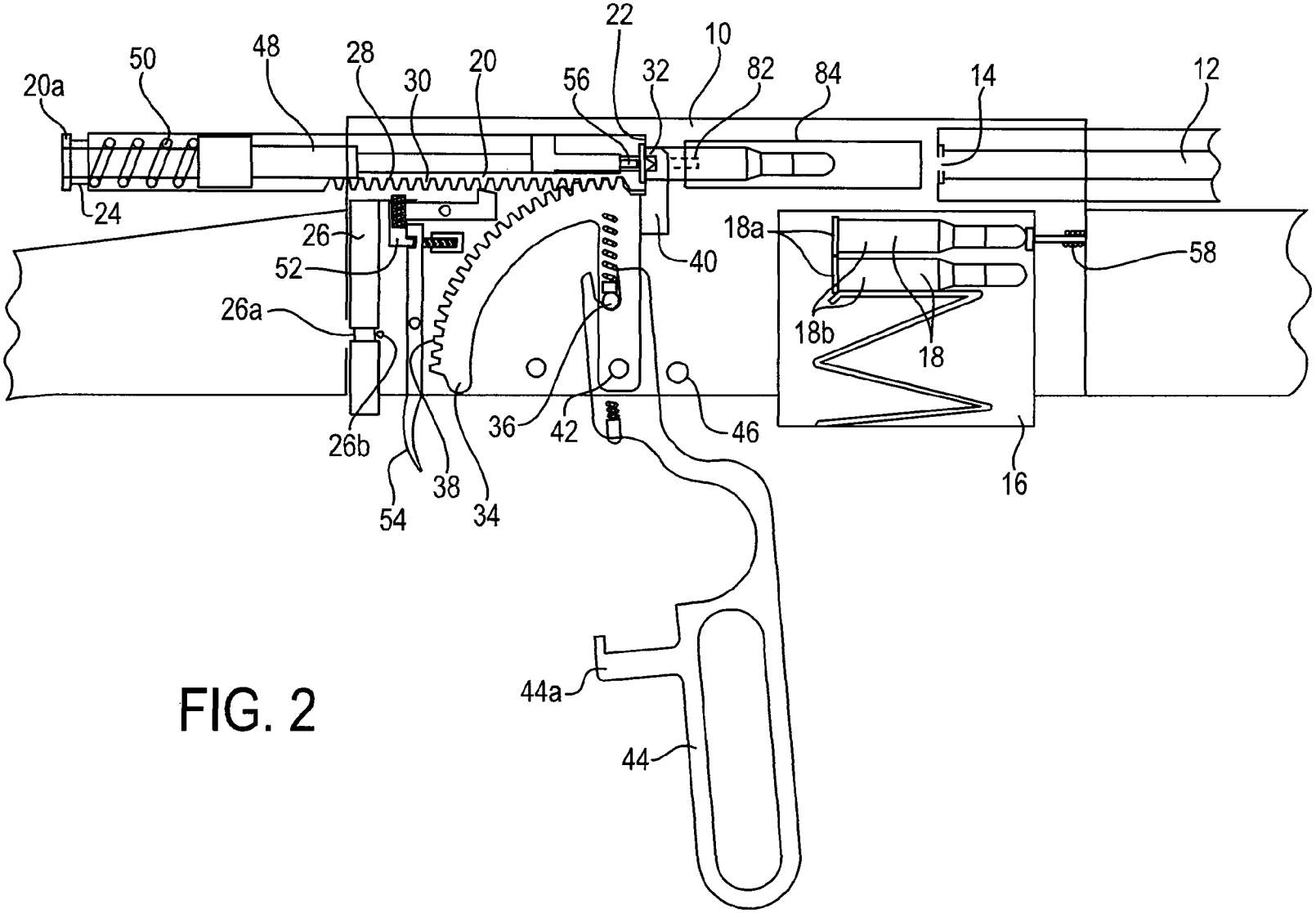
FIG. 2 is a cross section of a portion of a rack and pinion lever-action rifle with the bolt in the rearward position taken along the middle.
Figure 3:
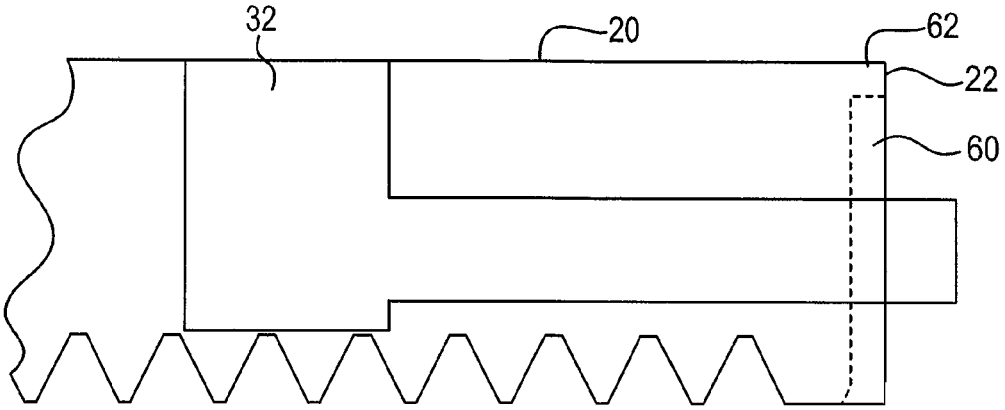
FIG. 3 is a side view of a portion of the sliding bolt with the bolt face with the extractor.

FIGS. 1-2 show a cross section of a portion of a preferred embodiment of a rack and pinion lever-action rifle. A receiver 10 is the frame or action body of the firearm, and is the housing that contains the mechanism that allows for the discharging of the firearm. A barrel 12 with a chamber 14 at one end is connected to the receiver 10. When the firearm is discharged, a propellant is ignited in the barrel 12, creating rapidly expanding gasses with pressure to force a projectile from the chamber 14 through the interior of the barrel 12 and out of the barrel 12. In a preferred embodiment, a removable cartridge magazine 16 into which cartridges 18 are loaded is attached to the receiver 10. Each cartridge has a rim 18*a* and a body 18*b*. The cartridge magazine 16 feeds the cartridges 18, one at a time, to be received by a sliding bolt 20.

The sliding bolt 20 reciprocates relative to the receiver 10 between an in-battery position, as shown in FIG. 1, and a rearward position, as shown in FIG. 2. In a preferred embodiment, a locking groove 24 in a sliding bolt cap 20*a* on the sliding bolt 20 engages with a bolt pin 26 when the sliding bolt 20 is approximately in the in-battery position, as shown in FIG. 1. In a preferred embodiment, the bottom of the sliding bolt 20 has a rack surface 28 with rack teeth 30 disposed along part of the rack surface 28.

An extractor 32 is located on the face 22 of the sliding bolt 20 and is contoured to receive and support the cartridge 18 when the sliding bolt 20 is approximately in the rearward position, as shown in FIG. 2.

A pinion 34 with a spring-loaded locking pin 36 and with pinion teeth 38 is connected to the receiver via a pivot pin 42, and arranged to mesh with the rack teeth 30 on the sliding bolt 20. When the pinion 34 pivots on the pivot pin 42 from the position shown in FIG. 1 to the position shown in FIG. 2, the pinion teeth 38 interact with the rack teeth 30 and cause linear motion of the bolt 20 from the position shown in FIG. 1 (i.e., the in-battery position) to the position shown in FIG. 2 (i.e., the rearward position). In a preferred embodiment, the pinion teeth 38 are disposed along an arc of approximately ninety degrees on the pinion 34.

A claw 40 is attached to the pinion 34 and configured to engage and extract a cartridge 18 from the cartridge magazine 16 and deliver the cartridge 18 to the face 22 of the bolt 20 and the extractor 32 when the pinion 34 pivots on the pivot pin 42 from the position shown in FIG. 1 to the position shown in FIG. 2.

A lever member 44 is connected to the receiver 10 via the pivot pin 42. In a preferred embodiment, one end of the lever member 44 is contoured so that the lever member may alternate between a coupled configuration, as shown in FIG. 2 and a partially uncoupled configuration, as shown in FIG. 1, with the pinion 34 via the spring-loaded locking pin 36 located on the pinion 34.

In a preferred embodiment, a pair of decoupling pins 46 is affixed to the receiver 10. The decoupling pins 46 are disposed to interact with the spring-loaded locking pin 36 when the pinion 34 pivots from the position shown in FIG. 2 and nears the position shown in FIG. 1, causing the spring-loaded locking pin 36 in the pinion 34 to be moved so that the pinion 34 and the lever member 44 are released from the coupled configuration shown in FIG. 2 to the partially uncoupled configuration shown in FIG. 1.

In a preferred embodiment, the lever member 44 interacts with the bolt pin 26, which is contoured to couple with the locking groove 24 in a sliding bolt cap 20*a* in the sliding bolt 20. The bolt pin 26 reciprocates towards the sliding bolt 20 and away from the sliding bolt 20 in a motion that is relative to the receiver 10. The motion of the bolt pin 26 causes it to alternate between a locked position when the sliding bolt 20 is in approximately the in-battery position, as shown in FIG. 1, and an unlocked position when the sliding bolt 20 is in approximately the rearward position, as shown in FIG. 2.

A hammer 48 is configured to reciprocate relative to the receiver 10 between a cocked position, as shown in FIG. 1, and an uncocked position, as shown in FIG. 2. The hammer 48 is disposed in relation to the sliding bolt 20 so that the sliding bolt 20 engages the hammer 48 as the sliding bolt 20 approaches the in-battery position, as shown in FIG. 1 from the rearward position shown in FIG. 2, causing the hammer to move into the cocked position from the uncocked position.

A hammer spring 50 is disposed so that motion of the hammer 48 as it approaches the cocked position results in compression of the hammer spring 50.

A spring-loaded sear 52 is pivotally attached to the receiver 10 and disposed to engage with the hammer 48 when the hammer 48 is in the cocked position.

A spring-loaded trigger 54 is pivotally attached to the receiver 10 and disposed to engage with the spring-loaded sear 52. When the trigger 54 is depressed, such as by a person firing the firearm, the trigger 54 pivots and releases the spring-loaded sear 52, which in turn causes the sear 52 to disengage from the cocked hammer 48.

When the sear 52 is disengaged from the cocked hammer 48, the hammer 48 moves under a force exerted by the hammer spring 50 towards a firing pin 56 disposed between the hammer 48 and the barrel 12 until the hammer 48 strikes the firing pin 56.

An ejector 82 is mounted in said receiver 10 and pushes spent cartridges 18 out of the receiver 10 through an ejector opening 84.

In a preferred embodiment, the cartridge magazine 16 further comprises a spring-loaded cartridge pusher 58 that positions the cartridge 18 so that the claw 40 may engage with the cartridge 18 for delivery of the cartridge 18 to the extractor 32.

Turning now to FIGS. 3-5B, the face 22 of the sliding bolt 20 and the extractor 32 in a preferred embodiment can be seen in greater detail.

A pocket 60 on the front of the face 22 has a shoulder 62 to contain the cartridge 18 that is open on one side. This allows the cartridge 18 to be loaded into the bolt face 22 and in front of the firing pin 56 by the claw 40 as the claw 40, which is disposed on the pinion 34, approaches the bolt face 22 as the pinion 34 pivots on the pivot pin 42. At the end of its travel, the claw 40 approaches the bolt face 22 so that a cartridge 18 carried by the claw 40 is moved over the side of the face 22 that does not have a shoulder 62 and deposited approximately in the center of the face 22. A stepped and beveled portion of the extractor 32 comprising a guide ramp 64 and a hook 66 extends out from the bolt face 22 slightly more than the thickness of the rim of the cartridge 18. The guide ramp 64 helps guide the cartridge 18 into position on the bolt face 22 without sticking or binding when the pinion 34 with claw 40 pivot away from the bolt face 22, the hook 66 of the extractor 32 holds the cartridge 18 in the bolt face 22.

A step 68 on a portion of the extractor 32 protruding beyond the bolt face 22 presses against the rim 18*a* of the cartridge 18. In a preferred embodiment, the extractor 32 is made from spring steel and is under spring tension when a cartridge 18 is engaged with the extractor 32 and the sliding bolt 20 on the bolt face 22. The extractor 32 pushes on the rim 18*a* of the cartridge 18 so that the opposite side of the rim 18*a* of the cartridge 18 is pressed against the shoulder 62 of the bolt face 22. This interaction between the extractor 32 the cartridge 18, and the bolt face 22 plus the hook 66 of the extractor 32 securely holds the cartridge 18 on the bolt face 22. This allows the sliding bolt 20 to feed the cartridge 18 into chamber 14 of the barrel 12 in a controlled fashion.

Figure 4A:
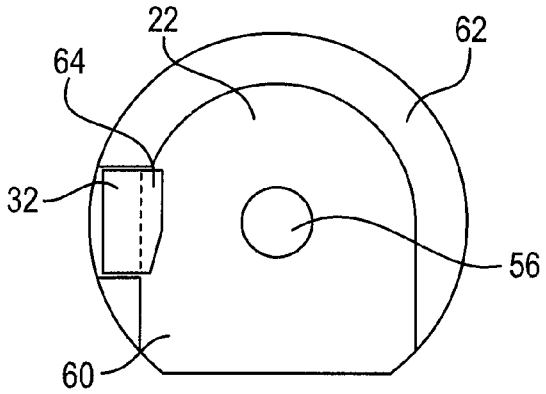
FIG. 4A is a front view of the bolt face with the extractor.
Figure 4B:
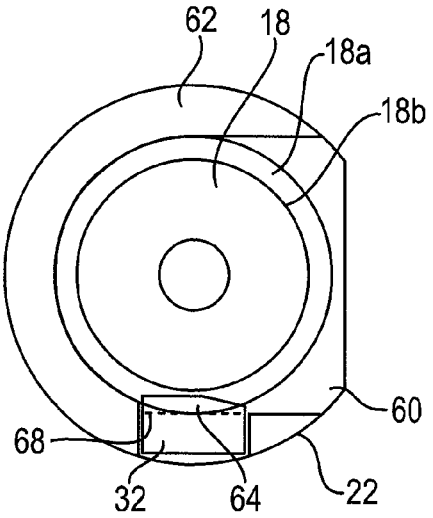
FIG. 4B is a front view of the bolt face with the extractor and a cartridge.
Figure 5A:
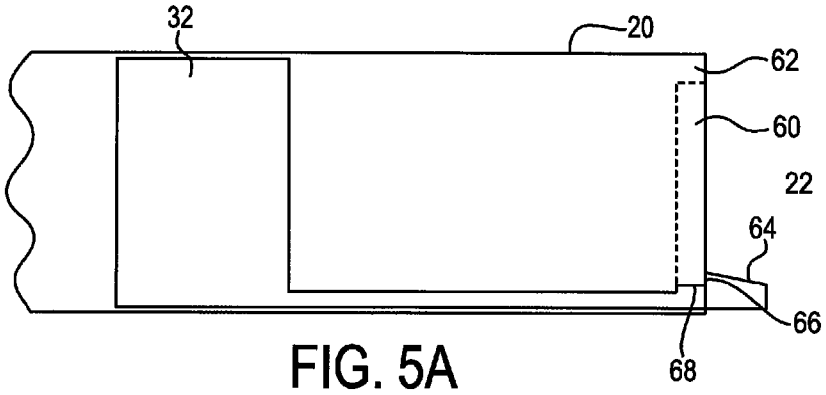
FIG. 5A is a top view of a portion of the sliding bolt with the bolt face with the extractor.
Figure 5B:
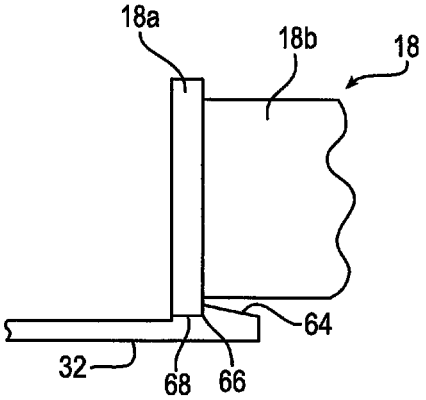
FIG. 5B is a top view of a portion of the extractor and a cartridge.

Referring to FIGS. 4B and 5B, the guide ramp 64 of the extractor 32 is contoured so that the extractor 32 is not in contact with the body 18*b* of the cartridge 18 when the claw 40 is interfacing with the bolt face 22 during delivery of a cartridge 18 from the cartridge magazine 16. The claw 40 is contoured so that it fits between the extractor 32 and the body 18*b* of the cartridge 18 without interference from the extractor 32 when loading a cartridge 18 into the bolt face 22. The guide ramp 64 helps load the cartridge 18 into place on the bolt face 22. In a preferred embodiment, single cartridge 18 loading directly into the chamber 14 is possible.

Figure 6:
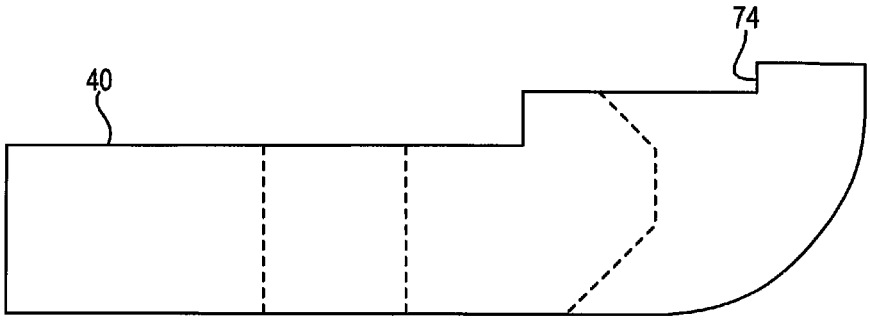
FIG. 6 is a side view of the claw.

Turning now to FIGS. 6-7A, the claw 40 in a preferred embodiment can be seen in greater detail. The claw 40 is configured to engage with and grab the cartridge 18, draw it up in an arc as the lever member 44 pivots, insert the cartridge 18 into the face 22 of the bolt 20, and release the cartridge 18 when the claw 40 pivots away from the bolt face 22 after having deposited the cartridge 18 on the bolt face 22.

The claw 40 has a first prong 70 and a second prong 72 that enable the claw 40 to engage with the cartridge 18 in the cartridge magazine 16. The claw 40 grabs the cartridge 18 from the cartridge magazine 16 in two ways. Catches 74 on the first prong 70 and second prong 72 of the claw 40 engage the rim 18*a* of the cartridge 18 to pull the cartridge 18 out of the cartridge magazine 16 as the claw 40 pivots away from the cartridge magazine 16 towards the face 22 of the sliding bolt 20. Also, the claw 40, in a preferred embodiment, is, between the first prong 70 and the second prong 72, approximately 0.001" narrower than the diameter of the cartridge body 18*b* near the rim 18*a*. As the claw 40 pivots in an arc from the position shown in FIG. 1 to the position shown in FIG. 2, and encounters a cartridge 18, the first prong 70 and second prong 72 engage the body 18*b* of the cartridge 18 near the rim 18*a* and the claw 40 exerts a slight spring pressure on the body 18*b*. The force of friction due to the slight pressure exerted by the first prong 70 and the second prong 72 of the claw 40 holds the cartridge 18 while the claw 40 pivots toward the bolt face 22. The force of friction is low enough so that the cartridge 18 is held securely but transferred to the bolt face 22 and the extractor 32 with no difficulty when the claw 40 engages with the bolt face 22. The top of the claw 40 pushes the rim 18*a* of the cartridge 18 into the bolt face 22 where it is latched by the extractor 32. The second prong 72 of the claw 40 is thinner than the first prong 70. The second prong 72 fits between the extractor 32 and the cartridge body 18*b*. The thickness of the second prong 72 is such that it applies the correct spring pressure on the cartridge 18 without touching the extractor 32. The claw 40 is contoured so that the claw 40 puts the cartridge 18 into the bolt face 22 so that the cartridge 18 is retained on the bolt face 22 by the extractor 32. The claw 40 is contoured to eliminate mechanical interference with the cartridge 18 during the full range of motion of the claw 40 as it pivots together with the pinion 34 to which it is connected. In one embodiment, the claw 40 is detachable from the pinion 34 and may be held into place on the pinion 34 by a claw screw 40*a*, preferably with an adhesive thread locking compound to eliminate accidental loosening of the claw screw 40*a*.

In an alternate embodiment shown in FIG. 7B, the claw 40 is pinned onto the pinion with a set of claw pins 40*b*.

In another alternate embodiment shown in FIGS. 7C-7F, the claw 40 is, attached to the pinion 34 by a dovetail socket 40*c* on the pinion 34 receiving a dovetail 40*d* on the claw 40. The dovetail 40*d* is inserted into the dovetail socket 40*c*.

In yet another alternate embodiment, shown in FIG. 7G, the claw 40 is an integral part of the pinion 34. The claw 40 and pinion 34 may be cast in this way by manufacturing methods including investment casting, or may be connected by manufacturing methods including welding or brazing.

Turning now to FIGS. 8A-8C, the components that allow the lever member 44 to alternate between a coupled configuration and a partially uncoupled configuration with the pinion 34 can be seen in greater detail. The user rotates the lever member 44 back and up to fully load the cartridge 18 into the chamber 14. When the sliding bolt 20 is all the way forward (i.e., in an in-battery position), the pinion 34 will not move due to engagement of the pinion teeth 38 with the rack teeth 30. The lever member 44 must move further up to push the bolt pin 26 into the locking groove 24 in the sliding bolt cap 20*a* at the back end of the sliding bolt 20. Such motion is possible when the lever member 44 and pinion 34 are in a partially uncoupled configuration. To alternate between a coupled configuration and a partially uncoupled configuration with the pinion 34, the pivot pin 42 which connects the receiver 10, the lever member 44, the pinion 34, and the spring loaded locking pin 36 function together. Starting when the lever member 44 is in the configuration shown in FIG. 1 and the bolt pin 26 is engaged in the locking groove 24 in the sliding bolt cap 20*a* in the back of the sliding bolt 20, the lever member 44 is rotated towards the configuration shown in FIG. 2. As the lever member 44 starts pivoting away from the receiver 10, the spring loaded locking pin 36 will slide deeper into a locking notch 76 on the lever member 44, securely coupling the lever member 44 and pinion 34. At this point, the lever member 44 and pinion 34 are one generally rigid assembly. The lever member 44 is cycled down and all the way forward (i.e., to the configuration shown in FIG. 2), then is rotated up and back (i.e., to the configuration shown in FIG. 1). As the lever member 44 gets close to the receiver 10, the sear 52 is engaged in the hammer 48 compressing the hammer spring 50. There is significant pressure on the lever member 44 therefore the lever member 44 must be a generally rigid assembly. At almost the furthest upward travel of the lever member 44, decoupling pins 46 fixed in the receiver 10 engage and push the locking pin 36 forward until the locking pin 36 moves into a decoupling notch 78 on the lever member 44 placing the lever member 44 in a partially uncoupled configuration with the pinion 34. The lever member 44 continues up whereby it pushes the bolt pin 26 into the locking groove 24 effectively immobilizing the sliding bolt 20. It is essential that the depth of the locking notch 76, which is located adjacent to the decoupling notch 78 (beyond the depth of the decoupling notch 78) is deeper than the diameter of the locking pin 36 so that the locking pin 36 can fully engage and securely lock with the locking notch 76 and, in effect with the lever member 44. This is essential to the success of the design. If the lever member 44 and pinion 34 were always in a coupled configuration, engaging the bolt pin 26 in the locking groove 24 would not be possible.

Turning now to FIG. 8D, the components that allow the bolt pin 26 to alternate between a locked position in the locking groove 24 when the sliding bolt 20 is in approximately the in-battery position, as shown in FIG. 1, and an unlocked position when the sliding bolt 20 is in approximately the rearward position, as shown in FIG. 2, are shown in greater detail.

When the sliding bolt 20 is in approximately the in-battery position, a pull-hook 44*a* disposed on the lever member 44 couples with a pull-hook recess 26*a* disposed on the bolt pin 26.

As the lever member 44 pivots from the position shown in FIG. 1 towards the position shown in FIG. 2, the pull-hook 44*a* pulls the bolt pin 26 out of the locking groove 24. Simultaneously, the pull-hook 44*a* moves gradually out of the pull-hook recess 26*a*, due to the arc of motion followed by the pull-hook 44*a* as it travels with the pivoting lever member 44. As the motion continues, the pull-hook 44*a* eventually completely exits the pull-hook recess 26*a*. This motion is reversed when the lever member 44 pivots from the position shown in FIG. 2 towards the position shown in FIG. 1, with the lever member 44 pushing the bolt pin 26 into the locking groove 24 and the pull-hook 44*a* moving into the pull-hook recess 26*a*.

A bolt pin retainer 26*b*, disposed in the receiver 10 projects into the pull-hook recess 26*a* at all times and prevents the bolt pin 26 from dropping out of the receiver 10, even when the pull-hook 44*a* is no longer in the pull-hook recess 26*a*.

Referring to FIGS. 1-2, when the firearm is ready for firing, with the hammer 48 and hammer spring 50 in a cocked position and the locking pin 26 in the locking groove 44, a safety feature may be employed by uncocking the hammer 48 and the hammer spring 50 by pivoting the lever member 44 from the position shown in FIG. 1 towards the position shown in FIG. 2 until the bolt pin 26 drops out of the locking groove 24. This will allow the hammer 48 and hammer spring 50 to decock, with the hammer spring 50 expanding without firing the firearm. The sliding bolt 20 with the sliding bolt cap 26*a* will protrude from the receiver 10 when the hammer 48 is decocked, and the hammer 48 will not protrude from the sliding bolt cap 26*a* providing for easy assessment of whether the hammer 48 is cocked or decocked.

Turning now to FIG. 8E, a sliding bolt cap 20*a* is disposed on the sliding bolt 20 and holds the hammer spring 50 in position. In one embodiment, the sliding bolt cap 20*a* has a screwdriver slot 20*b*, which can be used to screw the sliding bolt cap 20*a* into position on the sliding bolt 20 utilizing threads 20*c* that allow the sliding bolt 20 and sliding bolt cap 20*a* to be screwed together.

FIG. 8F shows a portion of the receiver 10 with the sliding bolt 20 and sliding bolt cap 20*a* protruding out of the receiver 10. Here, the hammer 48 is visible in the sliding bolt cap 20*a*, and is in an uncocked position.

FIG. 8G shows the hammer 48 protruding out of the sliding bolt cap 20*a*. Here, the hammer 48 is in a cocked position.

FIG. 8H shows some of the details of a sliding bolt cap 20*a* screwed into a sliding bolt 20, including the screwdriver slot 20*b* in in the sliding bolt cap 20*a* and interlocked threads 20*c* of the sliding bolt cap 20*a* and the sliding bolt 20.

Alternate embodiments of a bolt pin 26 are shown in FIGS. 8I-8J. As shown in FIG. 8I, the bolt pin 26 may be generally cylindrical in shape. In an alternate embodiment, the bolt pin 26 may be generally rectangular in shape as shown in FIG. 8J, and contoured to engage securely with locking groove 24 shown in FIG. 8H.

Turning now to FIGS. 9A-9D, various embodiments of the extractor 32 are shown. In one embodiment shown in FIG. 9A, the extractor 32 comprises a cantilever leaf spring with a clip 80 for attaching the extractor 32 to the sliding bolt 20.

In an alternate embodiment shown in FIG. 9B, the extractor 132 is a see-saw pivot-type extractor 132 with a pivot point 134 and a coil spring 136.

In another alternate embodiment shown in FIG. 9C, the extractor 232 is a rod cantilever-type extractor 232.

In yet another alternate embodiment shown in FIG. 9D, the extractor 332 is a hinge pivot-type extractor 332 with a hinge point 334 and a hinge coil spring 336.

From the description above, advantages of the invention become evident in that it allows for a smoother operating lever-action rifle than existing lever-action rifles, as well as for simpler safety features than in existing lever-action rifles.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A firearm, comprising:

a receiver;

a barrel having a chamber and joined to said receiver;

a cartridge magazine to contain a cartridge, where said cartridge magazine is removably affixed to said receiver;

a sliding bolt configured to reciprocate relative to the receiver between an in-battery position and a rearward position, where said sliding bolt comprises a face contoured to engage with the cartridge, a sliding bolt cap with a locking groove, and a rack surface with rack teeth disposed along at least a portion of said rack surface;

an extractor disposed on said face of said sliding bolt and contoured to receive and support the cartridge;

a pinion with a spring-loaded locking pin and with pinion teeth, pivotally connected to said receiver via a pivot pin affixed to said receiver, and arranged so that said rack teeth on said sliding bolt mesh with said pinion teeth so that pivoting of the pinion causes motion of the rack;

a claw disposed on the pinion and configured to engage and extract the cartridge from said cartridge magazine and deliver the cartridge to said extractor when said pinion pivots;

a lever member with a pull-hook, pivotally connected to said receiver via said pivot pin and configured to alternate between a coupled configuration and a partially uncoupled configuration with said pinion via said spring-loaded locking pin;

at least one decoupling pin affixed to said receiver and disposed to interact with said spring-loaded locking pin when the pinion pivots and to move said spring-loaded locking pin so that the pinion is released from said coupled configuration to said partially uncoupled configuration with said lever member;

a bolt pin with a pull-hook recess, contoured to couple with said locking groove and configured to reciprocate relative to the receiver between a locked position when said sliding bolt is in approximately the in-battery position and an unlocked position, and where said lever member is positioned to push said bolt pin into said locking groove as said lever member pivots towards said bolt pin, and where said pull-hook is disposed in said pull-hook recess when said bolt pin is coupled with said locking groove;

a bolt pin retainer disposed on said receiver and extending into said pull-hook recess;

a hammer configured to reciprocate relative to the receiver between a cocked position and an uncocked position and disposed in relation to said sliding bolt so that said sliding bolt engages the hammer as said sliding bolt approaches the in-battery position from said rearward position, causing said hammer to move into said cocked position from said uncocked position;

a hammer spring disposed so that motion of said hammer as it approaches said cocked position results in compression of said hammer spring;

a spring-loaded sear pivotally attached to said receiver and disposed to engage with said hammer when said hammer is in said cocked position;

a spring-loaded trigger, pivotally attached to said receiver and disposed to engage with said spring-loaded sear and to release said spring-loaded sear so that said spring-loaded sear disengages from said hammer when said trigger is depressed;

a firing pin disposed between said hammer and said barrel, wherein said firing pin is struck by said hammer towards said barrel when said sear is disengaged from said hammer;

an ejector mounted in said receiver; and an ejector opening configured to allow said cartridge to exit said receiver, once spent.

2. The firearm of claim 1 wherein said cartridge magazine further comprises a spring-loaded cartridge pusher.

3. The firearm of claim 1 wherein said extractor comprises a leaf spring with a clip.

4. The firearm of claim 1 wherein said extractor comprises a pivot-type extractor with a pivot point and a coil spring.

5. The firearm of claim 1 wherein said extractor comprises a rod cantilever-type extractor.

6. The firearm of claim 1 wherein said extractor comprises a pivot-type extractor with a hinge point and a hinge coil spring.

7. The firearm of claim 1 wherein said sliding bolt cap has a screwdriver slot and wherein said sliding bolt and said sliding bolt cap are removably attached via threads on said sliding bolt and said sliding bolt cap.

8. The firearm of claim 1 wherein said claw is an integral part of said pinion.

* * * * *